US005230475A

United States Patent [19]

Gerner

[11] Patent Number: 5,230,475

[45] Date of Patent: Jul. 27, 1993

[54] CONVEYOR SYSTEM FOR SHREDDER

[75] Inventor: Jeffrey E. Gerner, Milwaukee, Wis.

[73] Assignee: Banner Welder Incorporated, Germantown, Wis.

[21] Appl. No.: 988,815

[22] Filed: Dec. 10, 1992

[51] Int. Cl.[5] ..... B02C 23/00

[52] U.S. Cl. ..... 241/34; 198/626.3; 198/626.6; 198/861.1; 241/101.7; 241/186.35

[58] Field of Search ..... 241/34, 30, 101.7, 200, 241/186.35; 198/626.3, 626.5, 626.6, 861.1, 464.4, 589, 639, 301

[56] References Cited

U.S. PATENT DOCUMENTS

| | | | |
|---|---|---|---|
| 1,568,525 | 1/1926 | Osmera | 198/626.5 |
| 3,703,231 | 11/1972 | Montgomery | 198/626.6 |
| 4,069,911 | 1/1978 | Ray | 198/626.5 |
| 4,090,521 | 5/1978 | Elsner | 241/34 X |

*Primary Examiner*—Douglas D. Watts

*Attorney, Agent, or Firm*—Foley & Lardner

[57] ABSTRACT

A conveyor system for a shredder, e.g. a shredder useful for comminuting yard and garden waste, includes a hopper for receiving the material to be shredded and a rotating hammer mill for shredding the debris into small pieces. Material is moved from the bin to the hammer mill using a lower conveyor and an inclined upper conveyor, which together form a nip in the vicinity of the inlet to the hammer mill section. In the present invention, clogs and interruption of shredding are prevented by automatic or selective reversal of the direction of movement of one of the conveyors for a predetermined amount of time. In the most preferred form of the invention, the lower conveyor is reversed in direction to cause the upper portion of a pile of debris to be moved toward the nip by the upper conveyor, while clogged material therebelow is moved away from the nip for a predetermined amount of time.

23 Claims, 5 Drawing Sheets

CONVEYOR SYSTEM FOR SHREDDER

FIELD OF THE INVENTION

The present invention relates generally to the art of shredding equipment and more particularly to shredders of the type which may be used for such shredding operations as the comminuting of yard and garden waste into small pieces which are more biodegradable. The present invention also relates, in its most preferred form, to a method of preventing clogging of such shredding equipment at the nip formed between an upper conveyor and a lower conveyor and, still more specifically, to a system for reversing the direction of movement of one of the conveyors to unclog the nip section and improve the operating efficiency of the equipment.

BACKGROUND OF THE INVENTION

Shredding equipment has been known for a number of years and the sizes and applications of such devices vary widely. In the yard and garden equipment industry, chipper shredders are becoming more commonplace as states and municipalities mandate the composting of yard and garden waste, or as operators of composting sites find that their operations can be run more efficiently if waste such as branches, fallen trees, and the like are comminuted before the material is put into windrows or piles. The smaller pieces resulting from such operations biodegrade more quickly under suitable moisture and oxygen conditions and the volume required for the ultimate disposal of the material is also reduced. In recent years, mobile shredding machines designed for large scale operations have been known, including those sold under the Jenz trademark by the assignee of the present invention. A brochure illustrating such machines is included with this specification.

Such machines have included a generally rectangular collection hopper which can be loaded by front end loaders and the like with debris to be comminuted. The floor of the bin is a first endless conveyor adapted to move the debris from a rear portion to the opposite end of the machine. Prior machines have also included an upper conveyor, inclined at an acute angle with respect to the floor conveyor, and adapted to assist in moving material toward the nip formed between the two conveyors. A rotating hammer mill has been located at the outlet of the nip to receive material being moved by the conveyors. The hammer mill includes a plurality of hammer knife elements and a stationary cutting surface, all as is well known in the comminuting art for dividing the material into fine pieces which are discharged at the rear of the machine. Various modifications which are not relevant to the present invention include providing screens on the rear of the hammer mill to cause particles to stay in the shredding section for a longer period of time so that the average particle size can be reduced, and various devices for directing the discharge to a desired outlet location, which could be a windrow, a pile or the like.

In such prior equipment, one frequently encountered problem has been the clogging of machines when large bunches of the debris are being forced by the two conveyors toward the nip. Such clogs, in prior machines, have been removed by stopping the equipment and manually releasing a clog by spreading the material out to avoid the bunching which caused the problem in the first place. Such operations result in reduced efficiency for the equipment, and a system which would overcome this problem would represent a substantial advance in this technology.

SUMMARY OF THE INVENTION

The present invention features a yard waste shredder which includes drive systems for two conveyors adapted to prevent clogging by reversing the normal direction of travel for at least one of the conveyors. The present invention also features a system in which the angle of inclination of the upper conveyor varies, depending on the type of waste being treated at any given time. The present invention further features a dual conveyor system wherein one of the conveyors is automatically reversed for a predetermined amount of time when a clog occurs. The reversal of the direction of movement of one of the endless conveyors, in its most preferred form the lower conveyor, with respect to the other results in a shearing action upon the material which could clog the equipment, eliminating such clogs and improving machine efficiency.

How these features of the invention are accomplished will be described in the following detailed description of the preferred embodiment of the invention. Other ways in which they could be accomplished will appear to those skilled in the art after reading the present specification. Such other ways are deemed to fall within the scope of the present invention if they fall within the scope of the claims which follow.

DETAILED DESCRIPTION OF THE PREFERRED EMBODIMENT

Figure 1:
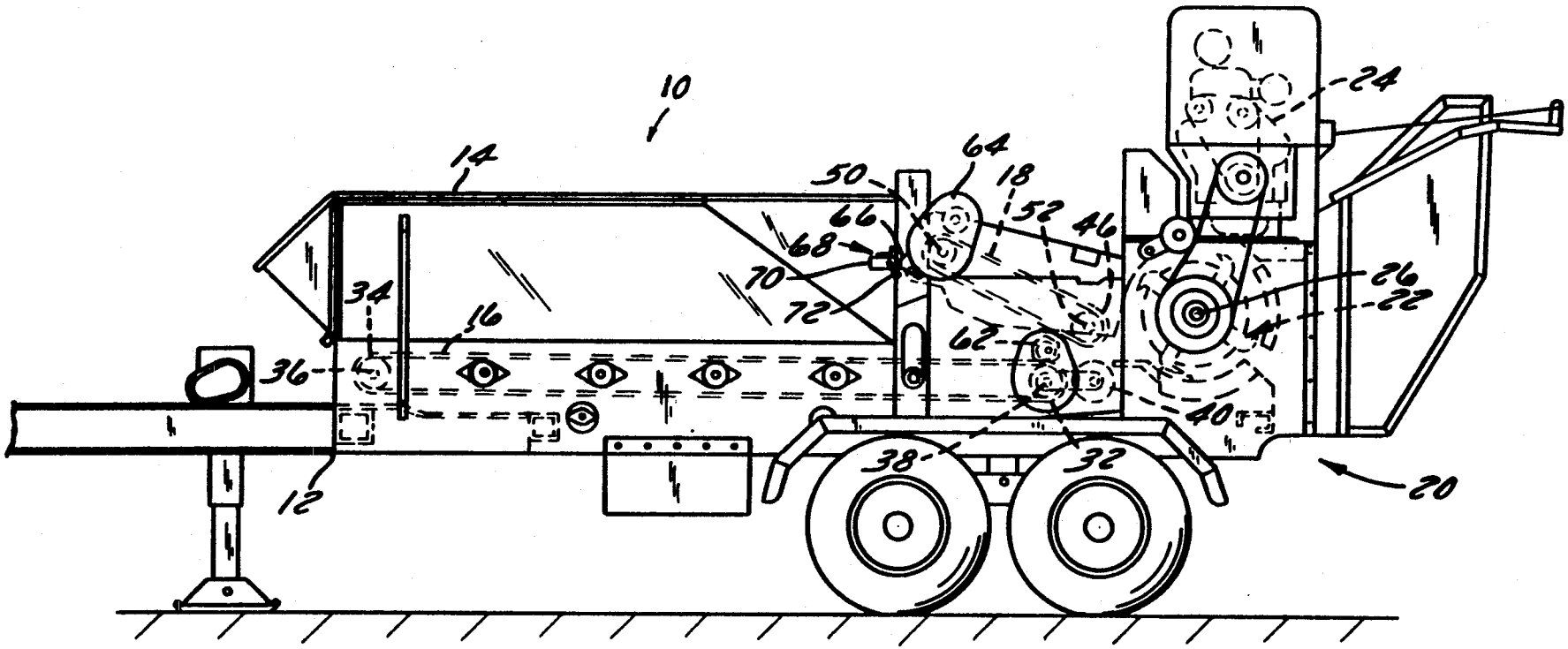
FIG. 1 is a side schematic illustration of a mobile waste shredder according to a preferred form of the present invention showing the overall layout for the equipment, including the location of the two endless conveyors with which the present invention is primarily concerned.

In the following description, a mobile waste shredder is discussed. As illustrated generally in FIGS. 1 and 2, a mobile waste shredder designated generally as 10 is configured to receive and comminute waste including leaves, brush, branches, etc. Mobile waste shredder 10 includes a frame 12 on which is mounted a hopper 14 for receiving waste which may be dumped into hopper 14 by a front end loader or other conventional methods. Disposed along the floor of hopper 14 is a lower or floor conveyer 16 which cooperates with an upper conveyer 18 to deliver the waste to a shredding section designated generally as 20.

Shredding section 20 includes a rotatable hammer mill 22 driven by an engine 24. Hammer mill 22 is mounted on a shaft 26 and includes a plurality of pivotable hammer knife elements 28 which pivot outward into proximity with stationary cutting bars 30 when hammer mill 22 rotates. As waste moves into shredding section 20, the waste is sheared into pieces between the moving hammers 28 and the stationary cutting bars 30.

Waste is supplied to shredding section 20 by lower and upper conveyers, 16 and 18. Lower conveyer 16 is an elongated endless conveyer having a first end 32 disposed towards shredding section 20 and a second end 34 disposed towards the opposite end of hopper 14. Lower conveyer 16 rotates around an idler gear shaft assembly 36 located at its second end 34 and is driven by a driving gear shaft assembly 38 located at its first end 32.

A feed roll 40 is positioned between lower conveyer first end 32 and hammer mill 22. Feed roll 40 receives waste delivered from lower conveyer 16 and assists in forcing the waste into shredding section 20. Preferably, feed roll 40 is driven by a roller chain 42 connected to a sprocket 44 mounted on driving gear shaft 38.

Upper conveyer 18 includes a first end 46 disposed in proximity to shredding section 20 and a second end 48 disposed generally away from shredding section 20. Conveyer 18 is an elongated endless conveyer driven by a driving gear shaft assembly 50 disposed at second end 48 and further rotating about an idler gear shaft assembly 52 disposed at first end 46. Upper conveyer 18 is oriented so that it forms an acute angle with lower conveyer 16 wherein first end 32 of lower conveyer 16 and first end 46 of upper conveyer 18 form a narrower nip area 54 through which material passes before entering hammer mill 22. As shown in the right side schematic view of FIG. 3, during normal operation upper conveyer 18 rotates in a counterclockwise direction (as viewed from the right) while lower conveyer 16 and feed roll 40 both rotate in the clockwise direction to cooperate in forcing the waste material into hammer mill 22.

In the preferred embodiment, upper conveyer 18 is allowed to pivot about a pivot shaft 55 disposed at second end 48. This allows nip area 54 to change in size depending on the amount of material passing between the conveyers. A hydraulic cylinder 56 is mounted between frame 12 and upper conveyer 18 to bias first end 46 of upper conveyer 18 towards lower conveyer 16, while allowing first end 46 to be forced away from lower conveyer 16 when a sufficient amount of debris is passing between the conveyers to generate the required separating force. Preferably, hydraulic cylinder 56 is connected to a hydraulic pump, preferably a hand pump, which is used to separate first end 46 from lower conveyer 16, e.g. for examination or maintenance of shredder 10.

Figure 2:
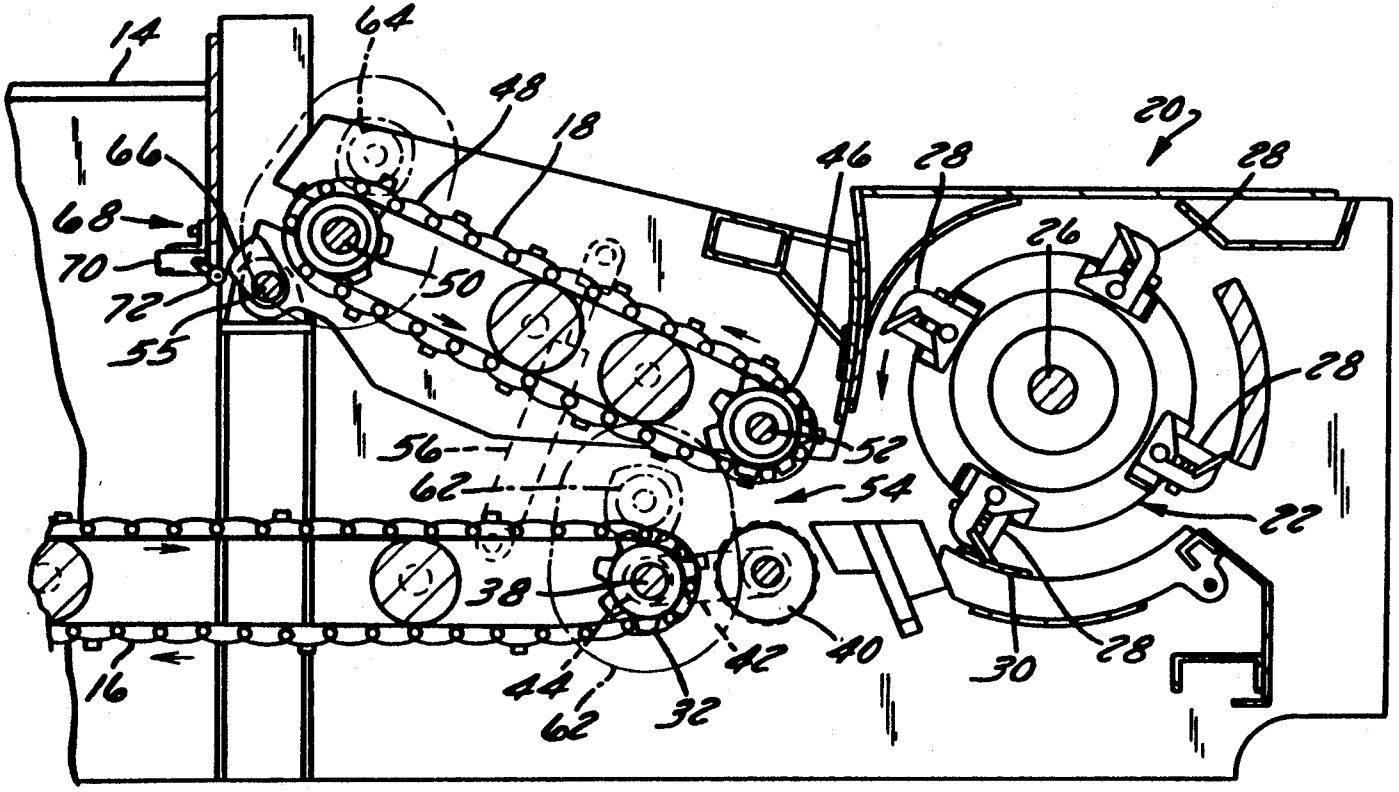
FIG. 2 is a detail right side view of the two conveyors shown in FIG. 1 illustrating the drive components and clog sensing mechanism therefor.
Figure 3:
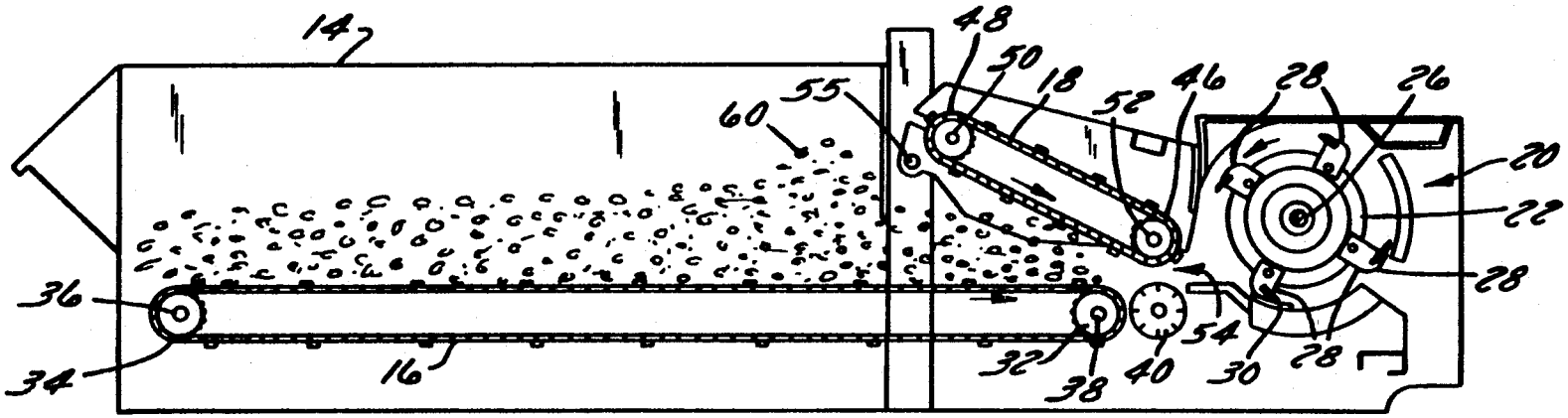
FIG. 3 is a schematic illustration of the conveyor systems only, arrows indicating normal direction of travel and illustrating yard waste approaching the nip area of the conveyors.

As illustrated in FIG. 3, sometimes a large mass of yard waste 60 moves towards nip area 54. Mass 60 could potentially clog or jam the hammer mill 22. In such event, it is desirable to reverse the direction of one of the conveyers, preferably floor conveyer 16, to provide a shearing or ripping action on mass 60. With one conveyer pulling the mass away from nip area 54 and one conveyer moving mass 60 towards nip area 54, the waste material will be ripped apart and spread out. After a predetermined amount of time, both conveyers are returned to their normal mode of operation to further deliver the waste into hammer mill 22. This shearing process is illustrated schematically in FIG. 4. The system for sensing a potential clog situation and reversing one of the conveyers in response thereto will be in explained in detail below with reference to FIG. 2.

In the embodiment illustrated in FIG. 2, floor conveyer 16 is driven by a hydraulic motor 62 which is connected to driving gear shaft assembly 38. Similarly, upper conveyer 18 is driven by a hydraulic motor 64 connected to driving gear shaft assembly 50. Additionally, a cam 66 is mounted on pivot shaft 55 for cooperation with a limit switch assembly 68. Limit switch assembly 68 preferably comprises a limit switch 70 such as the Cutler-Hammer Model No. E50AR170 combined with a lever operator 72. When a sufficient amount of waste moves between the upper and lower conveyers to pivot upper conveyer 18 about pivot shaft 55 beyond a predetermined range, cam 66 will pivot against lever operator 72 and activate limit switch 70.

Once this occurs, the movement of floor conveyor 16 is reversed while upper conveyor 18 continues to rotate in the same direction thus ripping mass 60 apart. As mass 60 is reduced in thickness, upper conveyor 18 gradually pivots back until it is within the desired predetermined range of pivotal movement and cam 66 no longer activates limit switch 70. At this point, lower conveyor 16 continues movement in its reverse direction for an additional predetermined amount of time, preferably three to five seconds, before returning to its normal direction of movement.

Cam 66 is appropriately mounted on pivot shaft 55 and limit switch assembly 68 is appropriately mounted on frame 12 so that the switch 70 will preferably be activated when upper conveyer 18 pivots through a range that separates its first end 46 from lower conveyor 16 at least a predetermined vertical distance of about 12 inches. In other words, nip area 54 preferably has a normal operating range of up to about 12 inches. This amount of movement, of course, can be changed or adjusted according to the type of waste, sharpness of the hammer knife elements, power of the engine, etc.

Figure 5:
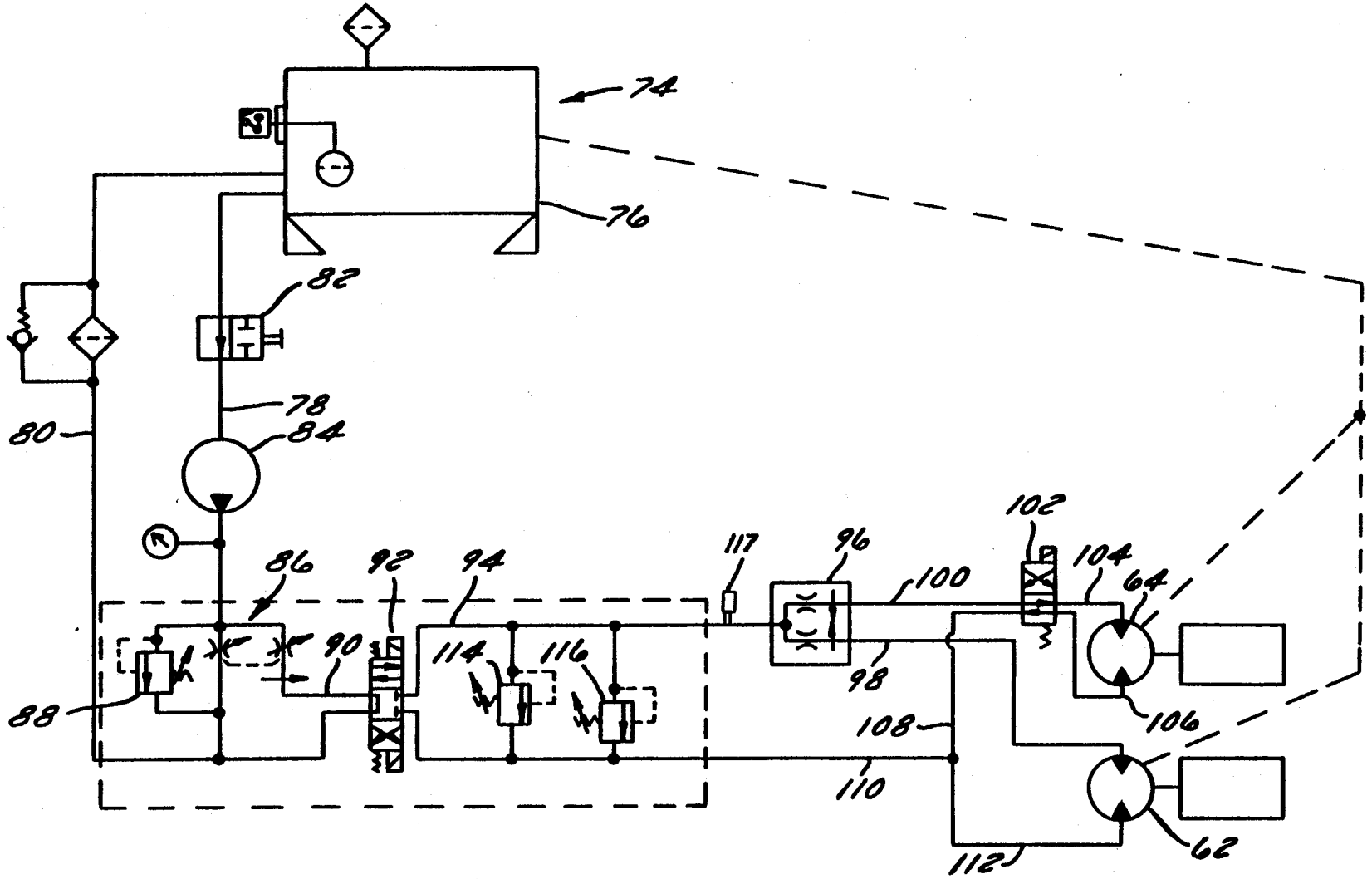
FIG. 5 is a hydraulic flow diagram showing the system for reversing the lower conveyor.

Limit switch assembly 68 cooperates with conventional control circuitry to control hydraulic motors 62 and 64 through a hydraulic system 74 shown generally in FIG. 5. Hydraulic system 74 includes a reservoir 76 which maintains a supply of hydraulic fluid. Reservoir 76 is connected to a fluid supply line 78 and a fluid return line 80. When operating, hydraulic fluid passes from reservoir 76 through a shut-off valve 82 to a pump 84. Pump 84 is connected to engine 24 and supplies the hydraulic system 74 with pressurized fluid to run hydraulic motors 62 and 64. Pump 84 is preferably connected to engine 24 through a conventional transmission.

Pump 84 delivers hydraulic fluid to a flow control assembly 86 which is connected to a relief valve 88. Flow control assembly 86 is used to adjust the amount of hydraulic fluid flowing through the system to control the speed of hydraulic motors 62 and 64, thereby controlling conveyer speed. Relief valve 88 will release hydraulic pressure if it increases beyond a given level in the vicinity of flow control assembly 86.

The hydraulic fluid flowing through flow control assembly 86 moves through a supply conduit 90 to a valve 92, preferably a solenoid controlled three position shuttle valve. As illustrated by FIG. 5, shuttle valve 92 provides straight fluid flow in its first position, no fluid flow in its second position, and cross-over fluid flow in its third position. In the second position, the hydraulic fluid is redirected back to reservoir 76. Under normal operating conditions, shuttle valve 92 is in the first position and supply fluid flows from supply conduit 90 into supply line 94 where the flow is split by a flow divider 96 into approximately equal portions which flow into fluid lines 98 and 100. Fluid line 98 delivers the hydraulic fluid to hydraulic motor 62 while fluid line 100 delivers hydraulic fluid to a reversing valve 102, preferably a two position solenoid controlled valve. In the first position, normal operating mode, reversing valve 102 conducts hydraulic fluid into a line 104 connected to hydraulic motor 64. This causes the upper conveyer 18 to move in a direction which forces material towards hammermill 22. In this normal operating mode, the lower conveyer 16 also moves in a direction which forces material towards hammermill 22.

After passing through upper hydraulic motor 64, the hydraulic fluid moves through a fluid flow line 106, back through reversing valve 102, into a flow line 108, and then back through a combined flow line 110. Similarly, the fluid moving through lower hydraulic motor 62 flows into a fluid flow line 112 which also returns the fluid to combined flow line 110. The fluid then returns through shuttle valve 92 and into return line 80 where it is returned to reservoir 76.

Additionally, a first crossover relief valve 114 and a second crossover relief valve 116 are connected between supply line 94 and combined flow line 110. The relief valves 114, 116 will release the hydraulic pressure if such pressure builds beyond a designated level between main shuttle valve 92 and the hydraulic motors 62, 64.

As discussed above, when the mass of yard waste 60, as shown generally in FIG. 3, moves towards nip area 54, first end 46 of upper conveyor 18 will be forced apart from first end 32 of lower conveyor 16. This action will pivot upper conveyor 18 about pivot shaft 55 until cam 66 contacts lever operator 72 and switches limit switch 70 to an open (activated) position. The conventional control circuitry responds by shifting main shuttle valve 9 to its third or crossover flow position while simultaneously shifting reversing valve 102 to its second or crossover flow position. The control circuitry will maintain the valves in this reverse mode position until mass 60 is sufficiently reduced so that cam 66 will no longer activate limit switch 70 and then preferably for an additional predetermined amount of time, e.g. approximately three to five seconds. After this predetermined time interval, main shuttle valve 92 and reversing valve 102 will each be returned to their first or straightflow positions and the normal operating mode will resume.

Figure 4:
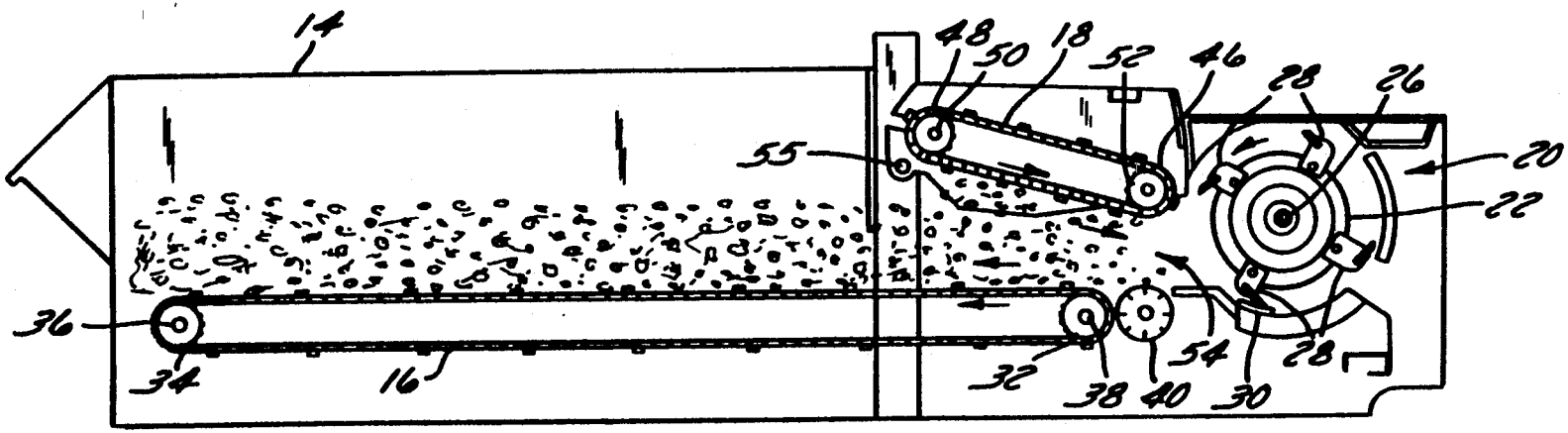
FIG. 4 is a schematic illustration similar to that of FIG. 3, but showing in schematic form, by the reversal of the direction of the lower conveyor, the shearing process acting on the waste to prohibit clogging of the equipment.

During the reverse mode (FIG. 4), upper conveyor 18 moves in the same direction as during the normal operating mode (FIG. 3), while lower conveyor 16 switches directions of rotation thus causing waste mass 60 to be torn or ripped in opposite directions as shown generally in FIG. 4. In other words, top conveyor 18 is moving the upper part of mass 60 towards hammer mill 22 while lower conveyor 16 is moving the lower part of mass 60 away from hammer mill 22. Effectively, this tears or rips mass 60 apart so that smaller amounts of material enter hammer mill 22, thus preventing clogging or any substantial decrease in rotational speed of the hammer mill.

Although it is preferred that lower conveyor 16 is reversed during reverse mode, the shearing action could also be achieved by reversing upper conveyor 18 while lower conveyor 16 continues to move mass 60 towards hammer mill 22. This could be achieved, for instance, by using reversing valve 102 in cooperation with hydraulic motor 62 and flow lines 98 and 112. Thus, when both reversing valve 102 and main shuttle valve 92 are moved to their crossover flow positions, the upper conveyor 18 reverses directions while the lower conveyor 16 maintains its same direction of movement.

In the reverse mode, hydraulic fluid supplied by pump 84 through supply conduit 90 flows into main shuttle valve 92 where it crosses over into combined flow line 110 until the fluid is split into two portions flowing through flow line 112 and flow line 108, respectively, in a flow direction opposite to that in the normal operating mode. The hydraulic fluid from line 112 flows through hydraulic motor 62 of lower conveyor 16 causing it to move in an opposite direction and tending to move debris away from hammer mill 22. The hydraulic fluid flowing through line 108 towards upper conveyor hydraulic motor 64, however, crosses over in reversing valve 102 to flow line 104. Thus, the hydraulic fluid flows from line 104 through hydraulic motor 64 and into flow line 106 in the same direction that it would under normal operating conditions, so upper conveyor 18 continues to move the waste towards hammer mill 22. The hydraulic fluid that returns from hydraulic motor 64 through flow line 106 crosses over in reversing valve 102 to fluid line 100, while the hydraulic fluid flowing through hydraulic motor 62 flows into fluid line 98. The hydraulic fluid from lines 98 and 100 flows in reverse direction through flow divider 96 and is combined in supply line 94 through which the hydraulic fluid flows back to main shuttle valve 92 where it crosses over into fluid return line 80 and is returned to reservoir 76.

The control circuitry used is conventional circuitry as would be used by one of ordinary skill in the art to control solenoid valves. Limit switch 70 is preferably connected to shuttle valve 92 and reversing valve 102 through a timer using time delay relays configured to provide the predetermined three to five seconds of additional ripping action after upper conveyor 18 returns to its normal operating range. Of course, the conventional circuitry can be modified according to the type of valves, location of valves, limit switch, or method of time delay. Preferably, a manual override switch is also connected into the control circuitry so that the lower conveyor can be reversed manually as well as automatically.

A pressure switch 117 may also be connected to supply line 94 as shown schematically in FIG. 5. Pressure switch 117 may be used alone or in combination with limit switch assembly 68. When the pressure in line 94 exceeds a certain predetermined level, pressure switch 117 will provide an output to the control circuitry which, in turn, will activate the appropriate valves to reverse, preferably, lower conveyor 16. In, the preferred embodiment, the pressure switch is a Nason, Model Number WS-1B-1600R/HR.

In an alternate embodiment, reversing valve 102 is connected across fluid line 98 and flow line 112. This allows the direction of motor 62 and lower conveyor 16 to be reversed simply by shifting reversing valve 102 to its second or crossover position while retaining main shuttle valve 92 in its first or straight flow position. With this configuration, if both main shuttle valve 92 and reversing valve 102 are moved to their crossover flow positions, the direction of the upper conveyor 18 will be reversed while lower conveyor 16 continues to move waste towards hammer mill 22.

Figure 6:
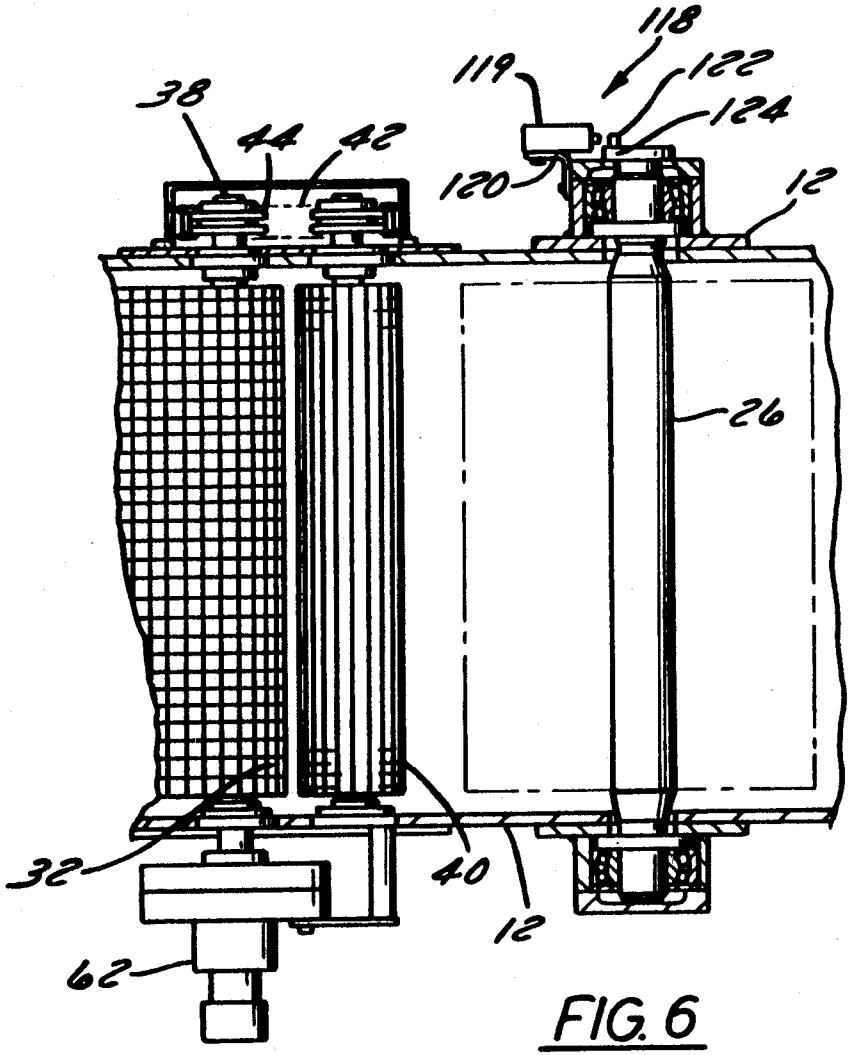
FIG. 6 is a top cut-away view of the hammermill showing the hammermill rotational speed sensor assembly.

Referring now generally to FIG. 6, a top cut-away view of hammer mill 22 is shown, including a rotational speed monitoring system 118 Speed monitoring system 118 includes a speed sensor 119, preferably a magnetic speed sensor such as the Synatel Model MK3 SUIKR designed to run on 12 volt direct current. Sensor 119 is mounted on a bracket 120 connected to a portion of frame 12, preferably in proximity to hammer mill shaft 26. Extending from the end of shaft 26 is at least one pin 122 which moves past rotational speed sensor 119 as shaft 26 rotates. In the preferred embodiment, pin 122 is a bolt which may be turned into a threaded bore 124 disposed in the end of shaft 26.

Hammer mill shaft 26 rotates pin 122 past speed sensor 119 one time per shaft rotation. The sensor 119, which includes an integral microprocessor connected to the control circuit, counts the number of times pin 122 passes during a given period to measure the rotational speed of hammer mill 22 and shaft 26. While shaft 26 is rotating above a predetermined set speed, hydraulic system 74 is maintained in its status quo mode. In other words, shuttle valve 92 and reversing valve 102 are positioned in either their reverse mode configuration or in their normal operating mode configuration.

However, if the rotational speed of shaft 26 drops below the predetermined set speed (preferably about 1200–1300 revolutions per minute), speed sensor 119 will signal the control circuit to move main shuttle valve 92 to its second position which blocks hydraulic fluid flow through the valve (see FIG. 5). Depending on the design of main shuttle valve 92, hydraulic fluid flow to either or both hydraulic motors 62, 64 is prevented. In this event, at least one of the conveyors and preferably both conveyors are stopped. This allows hammer mill 22 to shred the waste already in shredder section 20 without receiving any additional waste from hopper 14. Once hammer mill 22 is rotating at sufficient speed (e.g., above the predetermined set speed), speed sensor 119 will send the appropriate signal to the control circuit and main shuttle valve 92 will be returned to the mode in which it was operating before blocking the hydraulic fluid supply.

It will be understood that the foregoing description is of preferred exemplary embodiments of this invention, and that the invention is not limited to the specific form shown. For example, the valving arrangement may be switched so that the upper conveyor reverses rather than the lower conveyor, various conventional control circuits may be used, and different speed sensors can be used to detect the rotational speed of the hammer mill shaft. These and other modifications may be made in the design and arrangement of the elements without departing from the scope of the invention as expressed in the appended claims.

I claim:

1. A shredder comprising:

a shredding section;

a hopper adjacent the shredding section for receiving material to be shredded, the floor of the hopper being an endless conveyor;

a drive system for the floor conveyor arranged to move a load carried thereon to the shredding section;

a second endless conveyor being inclined with respect to the floor conveyor at an acute angle and spaced apart therefrom to form an infeed nip to the shredding section;

a drive system for the second conveyor arranged to assist in moving a load toward the nip; and means for selectively reversing the direction of movement of one of said floor conveyor or second conveyor.

2. The shredder of claim 1, wherein the reversing means is coupled to the floor conveyor.

3. The shredder of claim 1, wherein the reversing means is coupled to the second conveyor.

4. The shredder of claim 1, wherein the second conveyor is elongate and has a first end nearer the shredding section and a second end pivotably coupled to the shredder to facilitate movement of the first end away from the floor conveyor when a sufficiently large amount of material to be shredded passes through the infeed nip.

5. The shredder of claim 1, further comprising a means for sensing when the first end of the second conveyor moves beyond a predetermined distance from the floor conveyor, wherein upon movement beyond the predetermined distance, the sensing means communicates with the reversing means which then reverses the direction of movement of one of the conveyors.

6. The shredder of claim 5, wherein the sensing means comprises a cam affixed to the second conveyor for interaction with a switch assembly when the second conveyor's first end moves beyond the predetermined distance.

7. The shredder of claim 1, wherein the second conveyor is elongate and has a first end nearer the shredding section and means are provided for adjusting the space between the first end and the floor conveyor.

8. The shredder of claim 7, wherein the adjusting means includes at least one hydraulic cylinder coupled to the second conveyor, the second end of the conveyor being pivotally coupled to the shredder.

9. The shredder of claim 1, further comprising a timer coupled to the reversing means for causing the reversing of movement to occur for a predetermined period of time.

10. The shredder of claim 1, wherein the reversing means is coupled to a manually operable switch for causing the direction of conveyor movement to reverse when the switch is operated.

11. A method of preventing clogging of a shredder which includes a shredding section and a hopper located adjacent thereto, the shredder also including a pair of endless conveyors arranged to move material from the hopper to the shredding section, the first conveyor being located along the floor of the hopper and the second conveyor being an elongate conveyor arranged at an acute angle of incline with respect to the first conveyor, a nip being formed between the floor conveyor and a first end of the second conveyor, the method including the steps of:

loading material into the hopper;

driving both conveyors in a direction to cause the material to move toward the nip; and selectively causing one of the conveyors to reverse direction while the other conveyor continues to move in the direction required to move material toward the nip.

12. The method of claim 8, wherein the conveyor which is caused to move in the reverse direction is the first conveyor.

13. The method of claim 8, wherein the conveyor which is caused to move in the reverse direction is the second conveyor.

14. The method of claim 8, wherein the size of the nip between the first and second conveyors changes in response to the quantity of material passing through the nip.

15. The method of claim 8, wherein the step of selectively causing one of the conveyors to reverse directions is carried out automatically when the nip increases in size beyond a predetermined distance.

16. The method of claim 15, wherein the step of selectively causing one of the conveyors to reverse directions is carried out for a predetermined period of time after the nip returns to a normal operating range.

17. A mobile yard and garden waste shredder comprising:

a frame mounted on wheels;

a hopper on the frame adapted to receive the waste to be shredded and including an endless conveyor on its floor;

a drive system for moving the floor conveyor to transport waste to a first end of the hopper;

a rotatable hammer mill located at the first end;

means for rotating the hammer mill to shred waste conveyed thereto;

a second conveyor mounted to the frame and inclined at an acute angle with respect to the floor conveyor, a first end of the second conveyor being generally adjacent the hammer mill and being spaced apart from the floor conveyor;

a drive system for moving the second conveyor to assist in moving waste toward the hammer mill; and means for selectively reversing the direction of movement of one of the conveyors.

18. The mobile yard and garden waste shredder of claim 17, wherein the drive system for moving the floor conveyor and the drive system for moving the second conveyor comprise a first hydraulic motor and a second hydraulic motor respectively, each motor being driven by hydraulic fluid flowing therethrough.

19. The mobile yard and garden waste shredder of claim 18, wherein the reversing means comprises a main shuttle valve cooperating with a reversing valve to reverse the flow of hydraulic fluid through the first hydraulic motor.

20. The mobile yard and garden waste shredder of claim 19, wherein the reversing means comprises a cam cooperating with a limit switch.

21. The mobile yard and garden waste shredder of claim 19, wherein the reversing means comprises a pressure switch.

22. A shredder comprising:

a shredding section including a rotatable hammer mill mounted on a shaft;

a hopper adjacent the shredding section for receiving material to be shredded, the floor of the hopper being an endless conveyor;

a drive system for the floor conveyor arranged to move a load carried thereon to the shredding section;

a second endless conveyor being inclined with respect to the floor conveyor at an acute angle and spaced apart therefrom to form an infeed nip to the shredding section;

a drive system for the second conveyor arranged to assist in moving a load toward the nip;

means for sensing the rotational speed of the hammer mill; and means for stopping at least one of the conveyors when the rotational speed of the hammer mill drops below a predetermined set speed.

23. The shredder of claim 22, wherein the sensing means comprises a pin extending from an end of the shaft and a magnetic speed sensor mounted in proximity to the end of the shaft to count each passing of the pin.

* * * * *